United States Patent [19]

Mayfield

[11] 4,165,455

[45] Aug. 21, 1979

[54] STEAM OR HOT-WATER BOILER

[76] Inventor: Esther O. Mayfield, 5565 Thunderbird La., La Jolla, Calif. 92037

[21] Appl. No.: 819,877

[22] Filed: Jul. 28, 1977

[51] Int. Cl.[2] ..... H05B 9/06

[52] U.S. Cl. ..... 219/10.55 A; 219/10.55 R; 219/341

[58] Field of Search ..... 219/10.55 R, 10.55 A, 219/10.55 D, 341

[56] References Cited

U.S. PATENT DOCUMENTS

| | | | |
|---|---|---|---|
| 3,535,482 | 10/1970 | Kluck | 219/10.55 R |
| 3,778,578 | 11/1973 | Long et al. | 219/10.55 R |
| 3,920,945 | 11/1975 | Smith et al. | 219/10.55 R |
| 4,029,927 | 6/1977 | McMillan | 219/10.55 R |

*Primary Examiner*—Arthur T. Grimley

[57] ABSTRACT

The steam or hot-water boiler provides a water heating apparatus that utilizes electromagnetic energy to produce steam or hot water. The invention consists of a boiler chamber, a source of electromagnetic energy, a resonant cavity, a fluid level control means, a temperature control means and a pressure control means. Water from the feedwater and/or condensate return line is heated in the resonant cavity as it circulates through the boiler chamber. The resonant cavity ensures that heat transfer occurs near or at the water surface in order to produce steam efficiently. Steam is then collected at the main header that leads it to conventional work stations.

7 Claims, 1 Drawing Figure

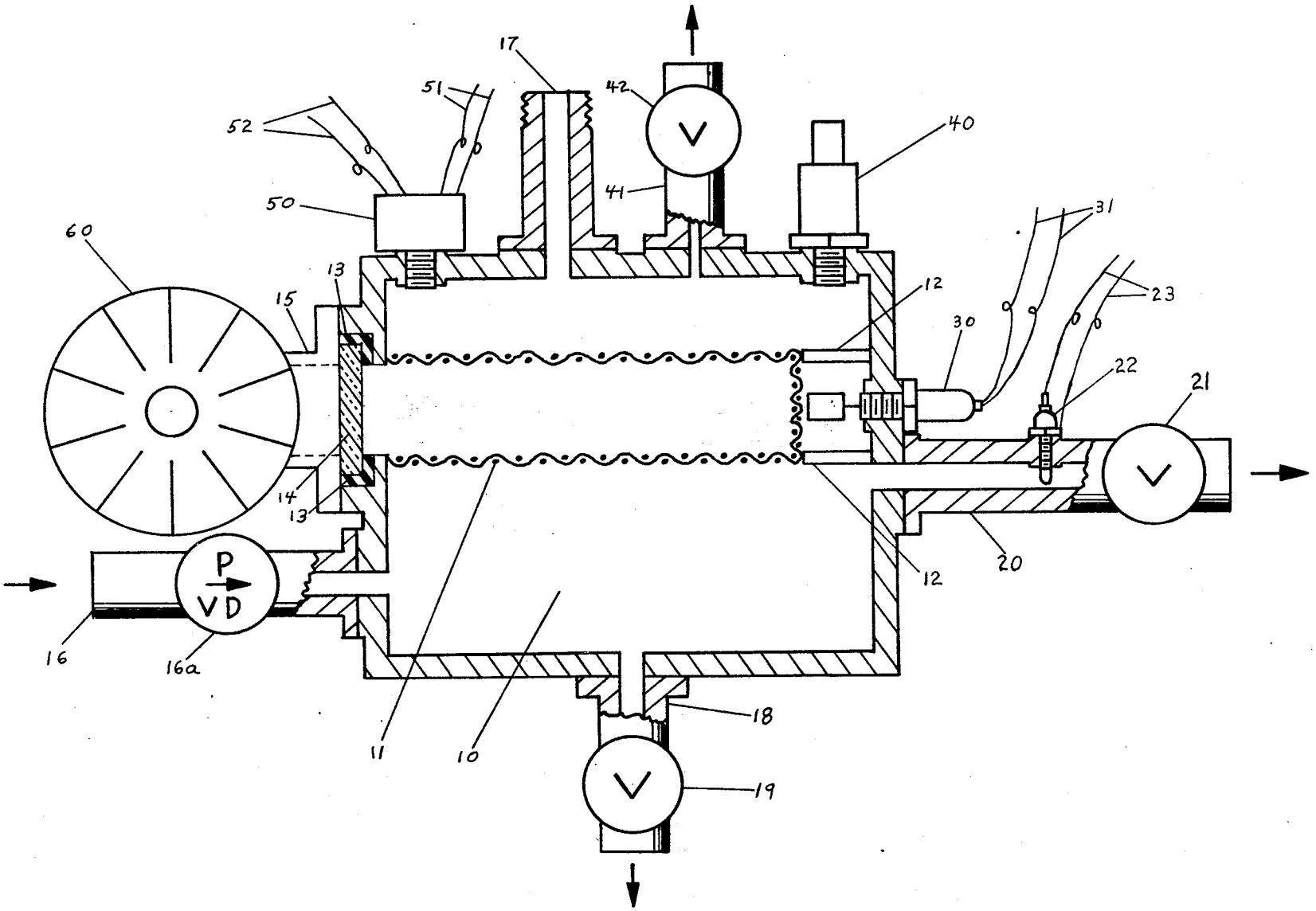
21
23
22
31
20
30
40
12
12
18
19
42
41
17
10
51
11
13
13
14
15
50
52
P
VD
16a
60
16

STEAM OR HOT-WATER BOILER

This invention relates to a steam or hot-water boiler and in particular boilers that utilize electromagnetic energy for heating.

The aim of the invention is to provide a boiler design that localizes energy for heating near or at the water surface during the production of steam. It is well known that an increase in temperature is observed in materials exposed to electromagnetic radiation within the microwave portion of the spectrum, as demonstrated in high-frequency heating devices. The rapid and efficient heat transfer means associated with microwave radiation can be applied to a resonant cavity structure located near or within the water line of a boiler chamber for the production of steam.

Accordingly it is the general object of this invention to provide a new and improved steam or hot-water boiler of the type utilizing radiated electromagnetic energy.

Another object of this invention is to provide a new and improved steam or hot-water heating apparatus of the type utilizing electromagnetic energy that is controlled by conditions of boiler pressure and/or water temperature.

It can be stated in essentially summary form that this invention may accomplish the above-cited objects by providing a steam or hot-water boiler having a source of electromagnetic energy, a resonant cavity, a feedwater and/or condensate return line control means, a water level control means, a pressure control means, a water temperature sensor means, and a main header to collect steam. Feedwater and/or condensate return line provides water from a conventional boiler water supply system to a standard input pipe and control valve which are connected to the boiler chamber. With initiation of operation by a pressure control, such as Pressuretrol, radiated energy from the electromagnetic energy source is coupled into a resonant cavity that is positioned near or within the water level line of the boiler. The electromagnetic energy is coupled from the waveguide into the cavity through a water-tight seal of material translucent to electromagnetic energy at the frequency of operation. The resonant cavity consists of grid wires with openings therein less than a half-wavelength of the radiant energy at the operating frequency of the magnetron. Hence, water and/or steam can circulate through the heating cavity structure. For use of the apparatus as a hot-water source, and immersion temperature sensor means detects the water temperature in the hot-water output line and controls the magnetron operation within the predetermined temperature limits. A main stream line collects steam and leads it to a conventional work station. A water level sensor means is positioned in the boiler to maintain the water at the desired level with respect to the resonant cavity structure. Power to the electromagnetic source is shut down with low water level conditions. Conventional safety valves and blow down lines may be provided in the chamber.

This invention may be used in any application where steam or hot-water is required.

Further objects and advantages of the present invention will become more apparent in view of the following detailed description and the attached drawing. The FIGURE is a schematic representation of the invention, including a resonant cavity.

Referring to the drawing, reference character 10 designates the boiler chamber preferably formed of any suitable material that insures water-tight integrity, of material having adequate thickness and construction to withstand the pressures to which the apparatus may be subjected. A resonant cavity 11 is supported inside the boiler by support beams 12. The cavity may be formed by grid wires having openings therein less than a half-wave-length of the radiant energy at the operating frequency of the magnetron. Feedwater and/or condensate return line input is provided through standard pipe connection 16 with a variable delivery pump **16*a* controlled by a fluid level switch 30. Hot-water may be drawn from the boiler through an output connection 20 which is located near the resonant cavity structure and is controlled by valve 21. Steam is collected at the main header 17 from which it passes through a conduit connected to the intended work station. A bottom blow down line 18 is controlled by valve 19** and is used to blow out any build up of sludge and sediment or to dump the boiler.

The means for supplying microwave energy to the resonant cavity 11 for heating the water load and producing steam is preferably a magnetron 60. The energy is coupled into the water-tight boiler 10 by waveguide section 15. Water-tight seal 13 and a translucent window 14 prevent water from entering the waveguide section 15. Translucent window 14 may be one of the standard heat resistant glasses having a thickness substantially less than a quarter-wave-length of the operating frequency of the magnetron source, yet of adequate thickness to withstand the pressures to which the boiler may be subjected. To localize energy at the water surface, grid wires which form the resonant cavity 11 have openings therein less than a half-wave-length of the radiant energy at the operating frequency of the magnetron. The resonant cavity grid wire structure allows water and steam to circulate through the heating cavity.

A conventional electrical pressure control means 50 is located at the highest part of the steam side of the boiler and is used to control the boiler's operating range and to start and stop the magnetron. Pressure control terminals 51 and 52 are connected to the supply voltage and power supply circuit of the magnetron respectively. An air cock means 41 and air cock vent valve 42 of conventional construction is used to vent the air from the boiler chamber when it is filled with water and to prevent a vacuum from forming in the boiler when taking it off the line. During use as a hot-water apparatus, an immersion thermostat 22 is of conventional construction and is electrical in character so that an increase in temperature above the desired output water temperature opens a contact and removes power to the electromagnetic source. Thermostat terminals 23 are in series with the magnetron power supply. If desired, thermostat 22 may be of adjustable nature to permit opening of the contact at different water temperatures. A water level indicator means 30 of conventional construction is located at the desired water level line to automatically provide water make-up from the variable delivery pump **16*a*. Fluid level switch terminals 31 also provide control for low water cut-off which removes power from the magnetron in the event the water make-up valve fails to function. A temperature and pressure safety valve 40** of conventional construction is located at the highest part of the steam side of the boiler and is connected directly to the chamber shell for safety purposes.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by the United States Letters Patent is:

1. A steam or hot-water boiler apparatus comprising:
a source of electromagnetic energy capable of producing high frequency energy,
a vessel adapted as a boiler chamber to contain water during heating, feedwater inlet and water outlet means connected to said chamber, said inlet and outlet being connected to a source of feedwater and to a conduit for leading heated water to a place of use respectively, said inlet and outlet having water-tight connections with respect to said chamber, a grid wire resonant cavity providing means for confining energy while heating water and releasing steam into the steam side of the boiler chamber, a main header to collect steam at the steam side of said chamber,
means for coupling energy from the source to said cavity, said means having water-tight connection with said cavity.

2. Structure as specified in claim 1 and further including a means for controlling the water line within or above the grid wire resonant cavity region.

3. Structure as specified in claim 2 and further including a means for low water cut-off to control an electric potential to said electromagnetic energy source.

4. Structure as specified in claim 3 and further including a thermally responsive means for maintaining the temperature of the water at the outlet under a selected temperature.

5. A steam or hot-wter boiler apparatus comprising:
an enclosure defining a chamber in which water can be exposed to electromagnetic energy confined within a grid wire resonant cavity structure,
means for generating electromagnetic wave energy of a wavelength falling in the microwave region of the electromagnetic spectrum,
means for guiding said energy to said cavity through which water flows,
means for monitoring water level to control feedwater flow and low water cut-off on said electromagnetic energy source.

6. Structure as specified in claim 5 and further including an automatic device means to start and stop on pressure demand and to control the operating range of said boiler.

7. Structure as specified in claim 6 and further including a thermally responsive means for maintaining the temperature of the water at the outlet under a selected temperature.

* * * * *